US006892897B2

(12) United States Patent
Stewart

(10) Patent No.: US 6,892,897 B2
(45) Date of Patent: May 17, 2005

(54) COLLAPSIBLE STORAGE DEVICE WITH MOVABLE CLOSURE ELEMENT

(75) Inventor: John Stewart, London (GB)

(73) Assignee: Spin Master Limited, Toronto (CA)

( * ) Notice: Subject to any disclaimer, the term of this patent is extended or adjusted under 35 U.S.C. 154(b) by 108 days.

(21) Appl. No.: 10/133,076

(22) Filed: Apr. 26, 2002

(65) Prior Publication Data

US 2002/0130127 A1 Sep. 19, 2002

Related U.S. Application Data

(63) Continuation-in-part of application No. 09/444,755, filed on Nov. 22, 1999, now Pat. No. 6,431,393.

(30) Foreign Application Priority Data

Nov. 24, 1998 (GB) ..... 9825586

(51) Int. Cl.[7] ..... B65D 43/14

(52) U.S. Cl. ..... 220/852; 220/830; 220/833; 220/845; 220/847; 220/490; 220/324; 220/213; 220/9.2; 220/6

(58) Field of Search ..... 383/2, 7, 42, 62, 383/119; 135/98, 123–126, 93, 128, 132, 133, 143; 160/84.01, 84.07, 36, 352; 150/120–130; 220/826, 493, 9.1–9.4, 990, 489, 213, 485, 252, 829, 287, 828, 315, 823, 324–326, 810, 731, 817, 847, 822, 845, 833, 666, 904, 6, 827

(56) References Cited

U.S. PATENT DOCUMENTS

| | | | | | |
|---|---|---|---|---|---|
| 400,588 | A | * | 4/1889 | Meyering et al. | 43/56 |
| 540,807 | A | | 6/1895 | Andrews | |
| 1,007,829 | A | | 11/1911 | Westbrook | |
| 1,080,478 | A | * | 12/1913 | Reis | 222/111 |
| 1,103,646 | A | * | 7/1914 | Baddeley | 229/199 |
| 1,126,236 | A | * | 1/1915 | Lees | 5/416 |
| 1,143,774 | A | | 6/1915 | Nicholls | |
| 1,233,117 | A | | 7/1917 | Parker | |
| 1,454,388 | A | * | 5/1923 | Lauren | 220/9.2 |
| 1,583,083 | A | | 5/1926 | Macaraig | |
| 1,779,159 | A | | 10/1930 | Coe | |
| 2,080,786 | A | | 5/1937 | Robles | |
| 2,250,729 | A | | 7/1941 | Smith et al. | |
| 2,508,398 | A | * | 5/1950 | Kelch, Jr. | 280/644 |
| 2,695,647 | A | | 11/1954 | Deutsch | |
| 2,767,757 | A | * | 10/1956 | Marder | 220/9.2 |
| 3,014,516 | A | | 12/1961 | Mueller | |
| 3,732,909 | A | | 5/1973 | Rooke et al. | |
| 3,802,450 | A | | 4/1974 | Huddle | |
| 3,831,650 | A | | 8/1974 | Consorti | |

(Continued)

FOREIGN PATENT DOCUMENTS

| | | | | |
|---|---|---|---|---|
| DE | 016741 | * | 10/1950 | 220/9.2 |
| FR | 2635754 A1 | | 3/1990 | |
| FR | 2 747 368 | | 10/1997 | |
| WO | WO 98/50279 | | 11/1998 | |

*Primary Examiner*—Robin A. Hylton
(74) *Attorney, Agent, or Firm*—Cohen, Pontani, Lieberman & Pavane

(57) ABSTRACT

A collapsible storage device comprising a resilient frame and sheet material with respect to which the frame is located. The resilient frame and sheet material form the side walls of the device and are movable between a flattened condition and an erected condition to which the resilient frame is biased. At one end of the device there is provided a base and at the other end there is provided an opening. The opening has a single closure element which has a first part attached to one side of the opening and a leading edge which can be moved about a pivotal point between a position at the said one side of the opening so that the storage device is open and a position at or in contact with the other side of the opening to close the opening. The closure element is movable with the storage device between flattened and erected conditions.

18 Claims, 5 Drawing Sheets

U.S. PATENT DOCUMENTS 3,848,615 A 11/1974 Warner et al.
4,116,206 A 9/1978 Warner et al.
4,116,465 A * 9/1978 Maclaren ..... 280/647
5,010,939 A 4/1991 King
5,139,070 A 8/1992 Kidd
5,439,017 A 8/1995 Brown
5,542,560 A 8/1996 Gerster et al.
5,625,982 A 5/1997 Foote
5,683,927 A * 11/1997 Dennison et al. ..... 438/231
5,690,134 A * 11/1997 McCauley ..... 135/133
5,960,983 A * 10/1999 Chan ..... 220/666
5,964,533 A 10/1999 Ziglar
6,123,091 A * 9/2000 Flynn et al. ..... 135/96
6,431,393 B1 * 8/2002 Stewart ..... 220/826
6,520,365 B2 * 2/2003 Schneider ..... 220/9.2
6,554,149 B2 * 4/2003 Schneider et al. ..... 220/9.3

* cited by examiner

COLLAPSIBLE STORAGE DEVICE WITH MOVABLE CLOSURE ELEMENT

CROSS REFERENCE TO RELATED APPLICATIONS

This application is a continuation-in-part (CIP) application of pending U.S. application Ser. No. 09/444,755 filed Nov. 22, 1999, now U.S. Pat. No. 6,431,393.

BACKGROUND OF THE INVENTION

The invention, which is the subject of this application, relates to a storage device of the sort in which articles such as clothing, toys, sporting articles and the like can be stored and retained in one place.

Conventional storage devices are commonly available and come in many forms such as toy chests, blanket boxes made of wood and storage baskets and containers made of plastics material and are self standing so as to be available for use readily. The conventional self standing device, in whichever form, has the disadvantage of becoming part of the furniture of a premises and in many instances the storage device can be unsightly and is required to be accommodated in the premises even when it is not in use. Furthermore the conventional free standing storage devices are bulky and can encroach onto the available floor area which is particularly noticeable in smaller rooms such as bed rooms, bathrooms and the like. The devices can also in certain instances represent a hazard, especially to children however they are regarded as being necessary in order to keep articles like toys, clothing and the like in one place.

It is known to provide storage devices which are free standing in use and can also be moved to a collapsed condition when not in use so as to prevent the same from taking up space when not in use. These devices can be moved between a collapsed or flattened condition and an erected condition by the provision of a helically wound spring member which is threaded along a helical passage in sheet material so that the sheet material forms the side wall of the storage device and the spring, when in its expanded condition, forms the device into an erected condition. Movement of this spring to a flattened condition or compressed condition causes the storage device to move to a collapsed condition. In the known device an opening is required to be provided to provide a funnel effect so that when an article is placed on the opening to be put into the device, the opening means protrude inwardly of the device. This therefore means that a substantial area of the available storage space within the device cannot be used as it is required to be left free for the protrusion inwardly of the opening means as, if this space was filled by articles then the opening means will not be able to extend inwardly to the required amount and so the opening means will not function correctly as a funnel.

SUMMARY OF THE INVENTION

The aim of the present invention is to provide improvements to the collapsible storage device which improve the utility of the device and allow improved use of the storage space within the device.

In a first aspect of the invention there is provided a collapsible storage device, said storage device comprising a resilient frame and sheet material with respect to which the frame is located, said resilient frame and sheet material forming the side walls of the device and movable between a flattened condition and an erected condition to which the resilient frame is biased and at one end of the device there is provided a base and at the other end there is provided an opening and characterized in that the opening is provided with a single closure element which has a first part attached to one side of the opening and a leading edge which can be moved about a pivotal point between a position at the said one side of the opening so that the storage device is open and a position at or in contact with the other side of the opening to close the opening, and the closure element is movable with the storage device between flattened and erected conditions.

In one embodiment the closure element is retained in position by a grommet or rubber band located at or adjacent the pivot point.

Preferably the closure element extends upwardly and away from a first part of the opening of the device when being closed. When the device is closed the leading edge of the closure element is positioned adjacent the edge of the opening opposite to the first part. When the device is open, the leading edge of the closure element lies in substantially the same plane as the opening. The provision of the closure element as described ensures that all of the storage device area defined between the plane of the opening and the base is available for the storage of articles therein.

Preferably the closure element is held in the closed position by retaining means.

In one embodiment the closure element comprises a number of rigid vanes/members which are attached at spaced intervals to sheet material which follows the movement of the pivotal action of the closure element between open and closed positions.

Preferably the form of the closure element will provide for a dome shaped closure when the same is in the closed position.

In one embodiment the closure element is provided with a lip portion. The lip portion can be provided adjacent or integrally formed with the leading edge of the element. Alternatively the lip portion can be provided on a non-movable or alternative edge of the closure element. The lip portion protrudes outwardly from the side walls of the container and closure element, thereby allowing easy gripping of the lip portion by a user to move the closure element between open and closed positions. In addition, the lip portion allows an increased number of designs to be provided for the storage device. For example, the lip portion of the closure element can be in the form of a peak of a hat or baseball cap and the side walls of the container can define a face and/or body of a character, person or animal.

In a second aspect of the invention, there is provided a collapsible storage device, said storage device comprising a resilient frame and sheet material with respect to which the frame is located, said resilient frame and sheet material forming the side walls of the device and movable between a flattened condition and an erected condition to which the resilient frame is biased and at one end of the device there is provided a base and at the other end there is provided an opening and characterised in that the opening is provided with a single closure element, said closure element having a first part attached to one side of the opening and a leading edge which can be moved about a pivotal point via pivotal action between a position at the said one side of the opening so that the storage device is open and a position at or in contact with the other side of the opening to close the opening, said closure element comprising a number of rigid vanes which are attached at spaced intervals to sheet material which follows the movement of the pivotal action of the closure element between the open and closed positions, and the closure element is movable with the storage device between flattened and erected conditions.

This form of storage device again allows all of the storage area to be used for the storage of articles therein.

Thus both the closure element and storage container are movable between fully collapsed and fully erected positions. The sheet material is flexible, thereby allowing collapse of the closure element and when erect, the sheet material is placed under a certain amount of tension to keep it taut between the substantially vanes.

In one embodiment, the closure element is attached to the device at at least one point to avoid the tendency for the closure element to be removed from the device and then discarded or lost.

In an alternative embodiment the closure element is attached to the device along a substantial portion of the periphery of the device, such as, for example, the peripheral top edge of the device, so that a portion of the closure element can be moved between open and closed positions.

Preferably all of the external surface of the side of the storage device is available for printed matter to be applied thereto and displayed in an uninterrupted manner.

Typically the resilient frame is attached to the internal surface of the sheet material on the closure element and/or storage device which, in addition to attaching the resilient frame to the sheet material, forms the same into a helical spring formation which allow the frame and the sheet material to be collapsible and movable to an erected condition.

Conventionally, the resilient frame means is located on the external surface and/or strengthening ribbing has been attached on the external surface of the sheet material at the location of the resilient frame means and this means that only the portions of the sheet material between the locations of the resilient frame means has been available for the printing of material thereon. This has been found to detract to a significant extent from the utility and attractiveness of the device as no substantial printed material can be applied to the external surface to give any significant effect and it is submitted that the invention of this aspect of this application greatly improves the utility of the device.

Typically the resilient frame is formed of spring steel or other suitable elongate member material.

In a yet further embodiment, the opening means can be defined by a moulded or otherwise formed article, which article can be formed to provide a visual effect which may add to the visual affect created by the addition of the printed matter to the side wall.

In one embodiment of the invention, the storage device comprising a base, side walls mounted with a resilient frame and a closure element and is used as a play device by children. In order to improve the safety of the device at least one aperture is provided in the sidewalls and/or base of the device.

Preferably the at least one aperture is in the form of netting or mesh located on a portion of the closure element.

In one embodiment, a number of apertures which are preferably in the base of the device so as to improve ventilation into the interior of the device without affecting the appearance of the same.

Preferably the sheet material comprises any suitable material such that for example the base may be made from a waterproof material to prevent leakage into the goods held in the device. The sheet material can also be made from fire retardant material to meet the relevant safety standards.

The side walls of the storage device preferably define a cylindrical storage device.

Preferably retaining elements are provided adjacent the base of the device to maintain the device in a collapsed position. The retaining elements are secured to a top portion of the closure element or top edge of the device.

In one embodiment a single closure element is provided but either the leading edge or the opposite edge can be pivotally moved between open and closed positions. The edge which is not opened can be secured to a peripheral edge of the device by retaining means. Thus a device is provided having a single closure element which can be opened from either side.

DESCRIPTION OF THE DRAWINGS

Specific embodiments of the invention will now be described with reference to the accompanying drawings, wherein.

DESCRIPTION OF THE PREFERRED EMBODIMENTS

Figure 1A:
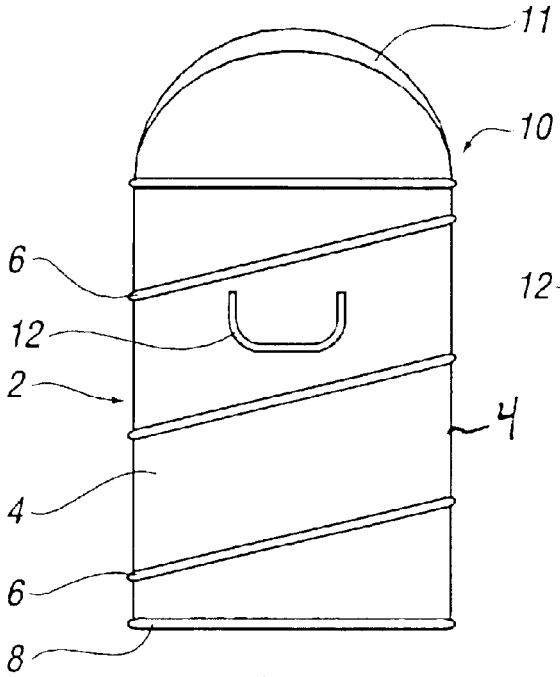
FIGS. 1A to 1F illustrate a storage device according to the invention with single closure element in one embodiment of the invention.
Figure 1B:
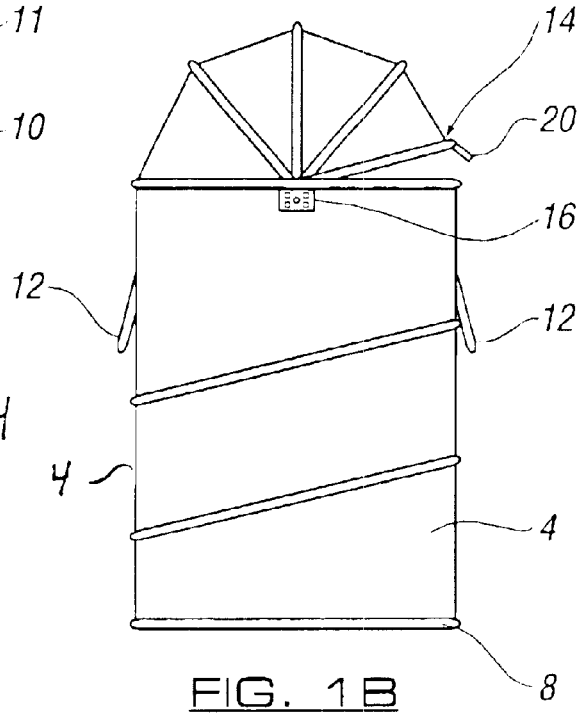

Referring firstly to FIGS. 1A–1F and 2A–2B, there is illustrated a storage device 2 which comprises side walls 4 in erected condition and which are maintained in the erected condition by a resilient frame means 6. At one end of the side wall 4 there is provided a base portion 8 and at the other end an opening 10 with single closure element 11. Handles 12 are provided on the side walls 4 of the device.

Figure 1C:
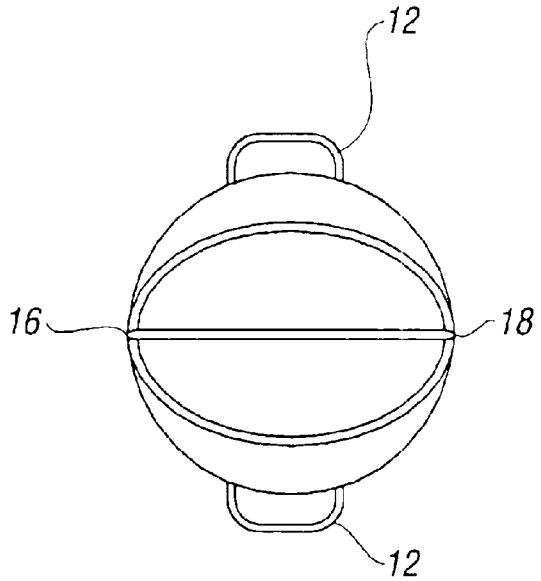
Figure 1D:
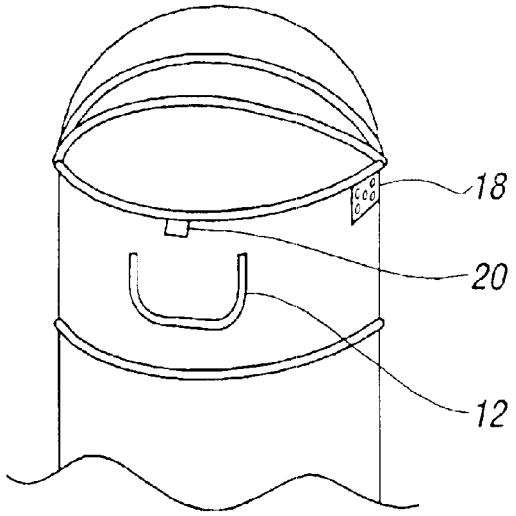

The closure element 11 is pivotally movable about pivot points 16, 18 on the storage device and forms an inverted bowl shape or dome shape when in a closed position as shown in FIGS. 1A, 1C and 1D. The leading edge 14 of the closure element can be secured to the side walls of the storage device by retaining means 20 as shown.

Figure 1E:
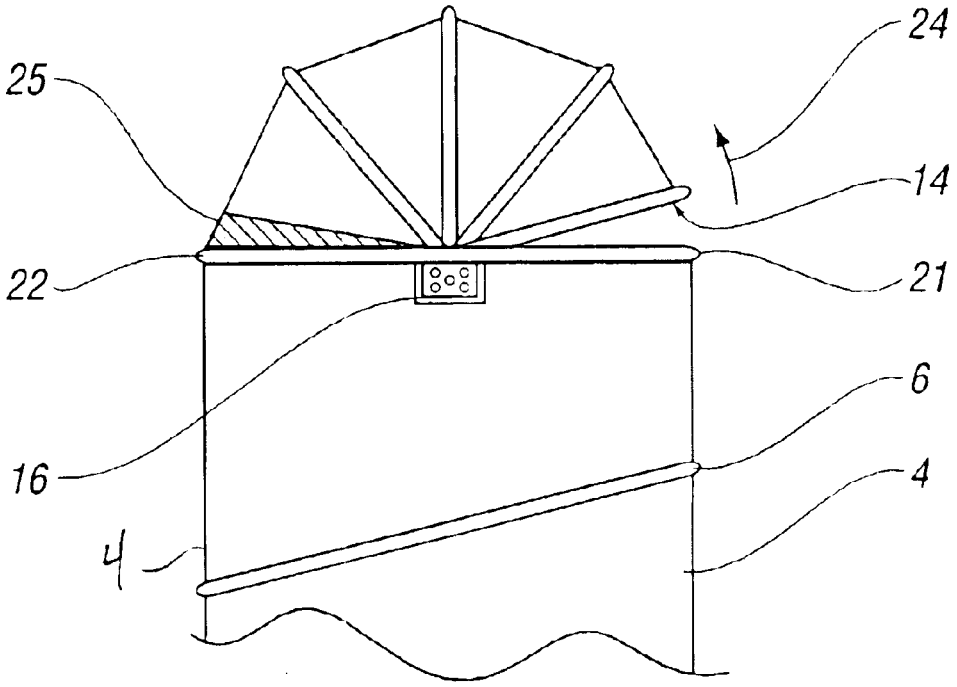
Figure 1F:
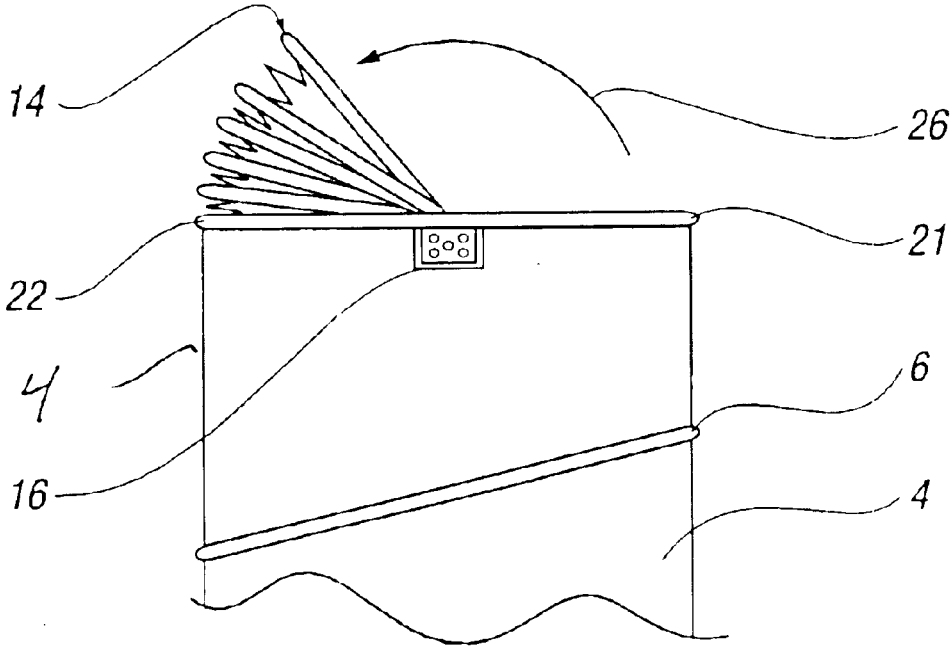

To allow access to be gained to the interior of the storage device, the retaining means 20 is released and the leading edge 14 is pivotally moved back from edge 21 to edge 22 as shown by arrows 24, 26 to lie on the peripheral edge 22 of the storage device sidewall opening, in a concertinaed arrangement, as shown in FIG. 1F. The entire area of the opening is then available for the placement of articles and removal of articles into and from the storage device interior. It will also be appreciated that the closure element 11 depends upwardly from the ends of the sidewalls, so that the entire interior of the storage device defined by the side walls and base is available for the storage of articles. The requirement of operation of the closure element does not restrict the available area as in conventional devices.

A netting portion 25 is provided on a part of the closure element to allow air to pass into the device for safety reasons as shown in FIG. 1E.

Figure 2A:
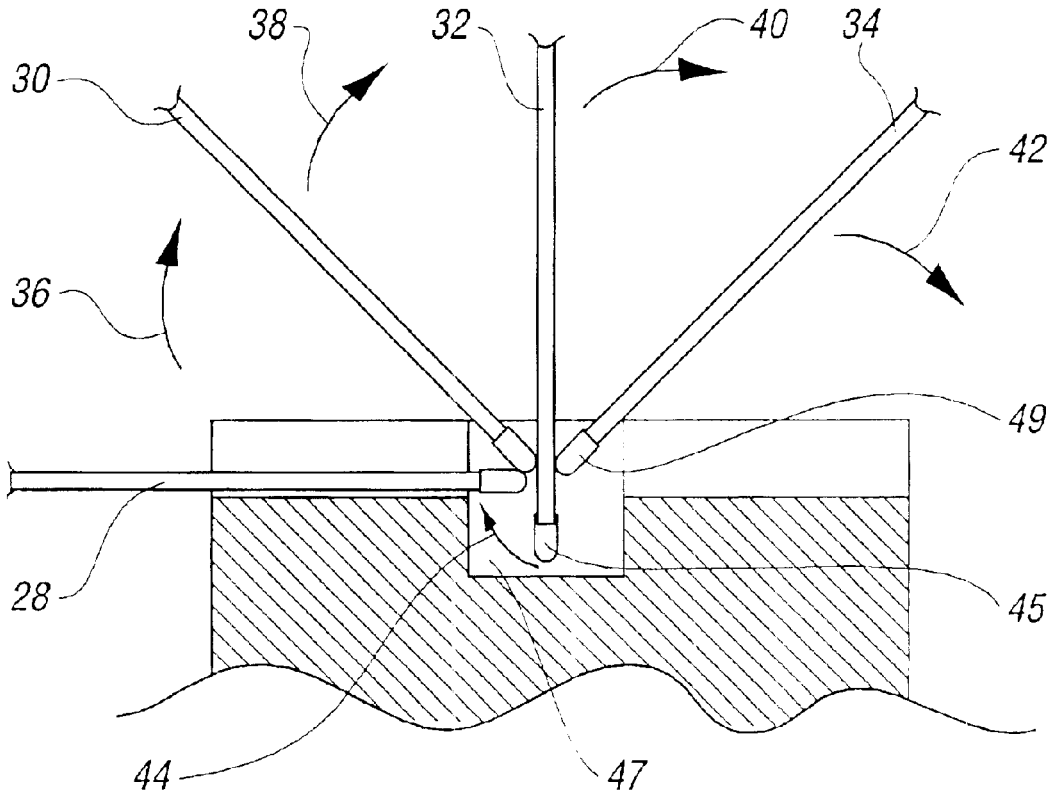
FIGS. 2A–2F illustrate various embodiments of the pivoting detail of the opening means of FIGS. 1A–1F.
Figure 2B:
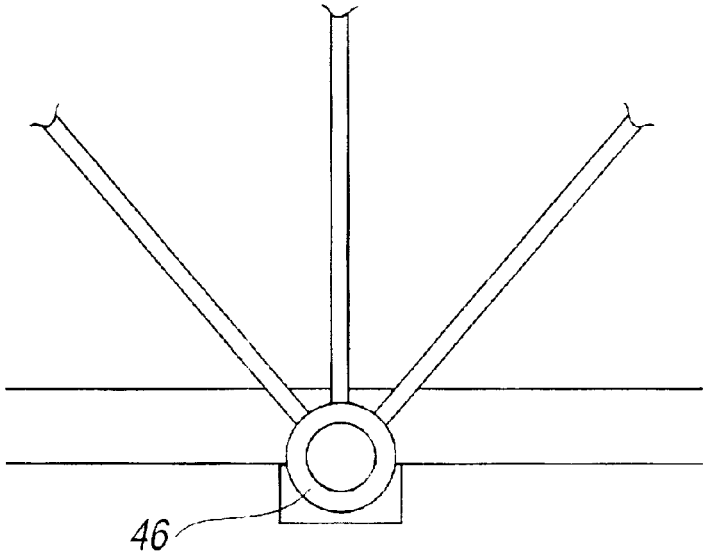

FIGS. 2A–2F illustrate alternative pivot point arrangements. In FIG. 2A each of the rigid vanes 28, 30, 32, 34 forming the closure element are separately pivotally movable by movement of the leading vane 34 corresponding to leading edge 14 as shown by arrows 36, 38, 40, 42, 44. In FIG. 2B the rigid vanes of the closure element 11 are pivotally movable about a common point 46 as shown.

Figure 2C:
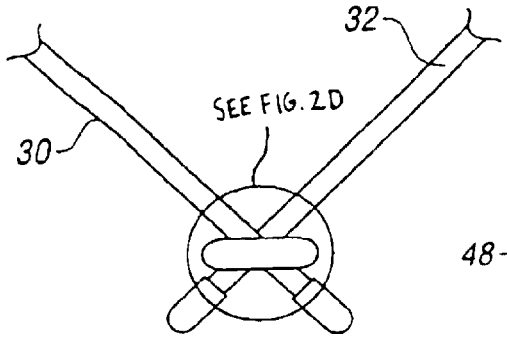
Figure 2D:
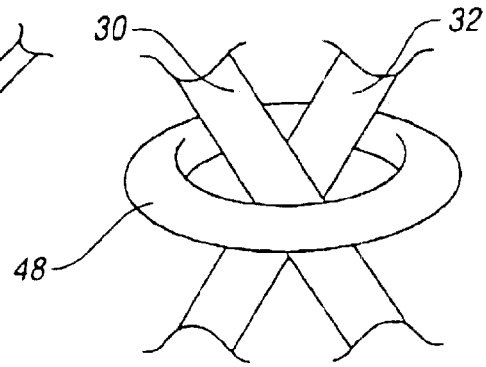
Figure 2E:
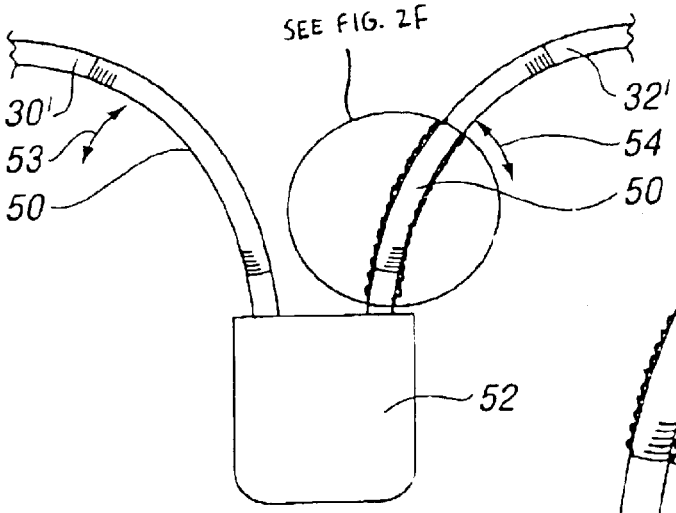
Figure 2F:
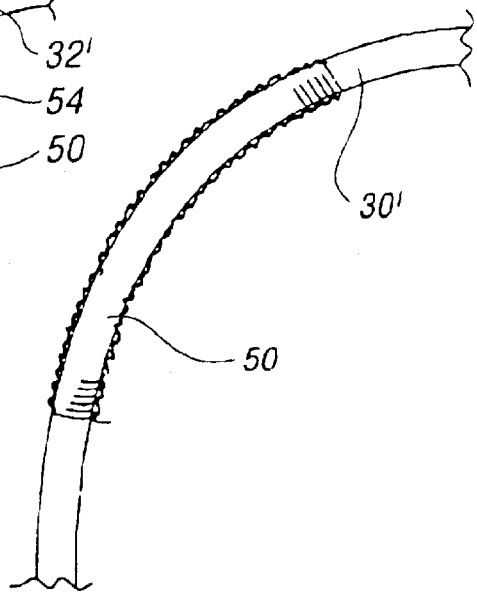

FIGS. 2C and 2D illustrate a variation on FIG. 2A. FIGS. 2C and 2D illustrate the vanes of closure elements being retained by connecting means 48 in the form of a grommet or rubber band which retains the vanes 30, 32 in relationship (only two of the vanes have been shown for purposes of clarity). FIGS. 2E and 2F illustrate a further embodiment wherein each of the vanes 30', 32' is provided with a resilient portion 50 in the form of a spring or rubberised section and which allows the vanes to be movable about a support 52 as shown by arrows 53, 54 between the open and closed positions.

The relatively rigid vanes 28, 30, 32, 34 as shown in FIGS. 2A & 2B are attached at spaced intervals to sheet material which follows the movement of the pivotal action of the leading vane 34 between open and closed positions. Although shown in relation to a cylindrical storage device, it should be appreciated that this type of opening can be provided in appropriate shape to match the cross section of the storage device. In addition, any number of vanes can be provided depending on the support required for the sheet material. Caps 49 can be provided on the free ends of the vanes to prevent any sharp ends from injuring the user or damaging the sheet material.

Vane 32 is typically provided with an end 45 which may be hooked or straight as shown, and which is located in a pocket 47 formed from sheet material. The pocket 47 is formed so as to allow longer vane 32 to pivot within the same. Thus the other vanes are maintained substantially in position and pivotally movable about vane 32. The pocket and vane 32 can be moulded from plastic material and/or made from sheet material.

Printed matter can be provided across the entire external wall of the device. This is possible as the resilient member 6 is engaged in a passage which is of a helical form as shown by the stitching in broken lines said passage is formed on the interior surface of the side wall. This therefore means that firstly the passage is hidden from view externally, secondly that the entire external surface is available for the application of printed matter thereon and, thirdly, that any strengthening material which is typically applied is applied to the interior surface again leaving the entire external surface available for the printing of material thereon and which has not previously been possible.

Figure 3A:
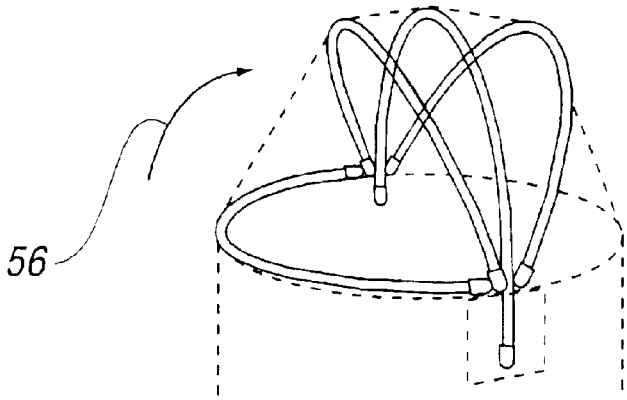
FIGS. 3A to 3D illustrate further embodiment and uses of the closure element of the storage device according to the invention.

FIG. 3A illustrates the embodiment of the storage device in FIGS. 1A–1F showing the rigid vanes and the sheet material in dotted lines. The arrow 56 illustrates the movement of the vanes and sheet material in moving the closure element between a closed and open position.

Figure 3B:
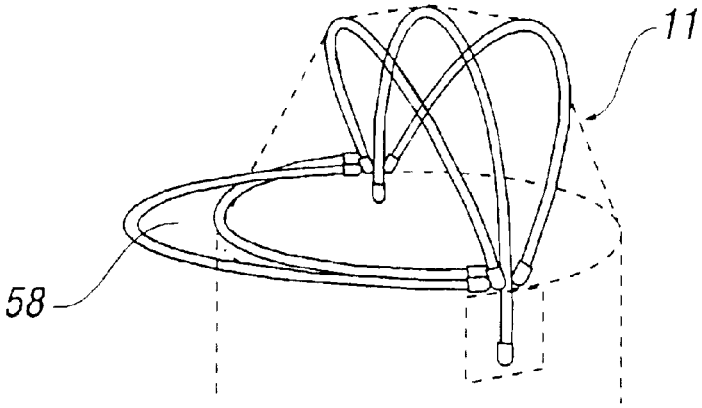
Figure 3C:
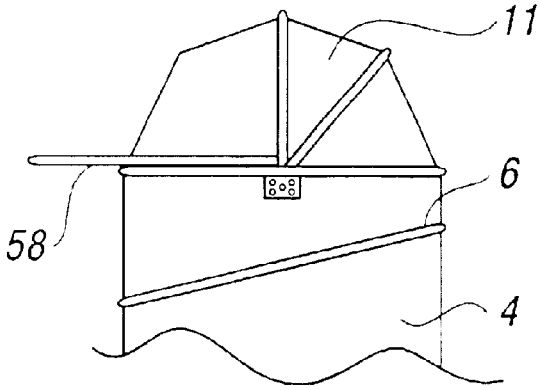
Figure 3D:
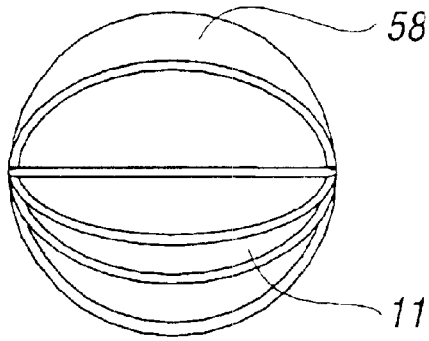

FIGS. 3B, 3C and 3D illustrate a further embodiment of the storage device with a lip portion 58 being provided on the closure element 11. The lip portion 58 is adjacent the leading edge of the closure element and allows a user to grip the closure element to move the same between open and closed positions. It also allows a greater variety of designs to be produced, thus for example, the lip portion could be a peak of a baseball cap or similar.

While the invention has been described with a certain degree of particularly, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. A collapsible storage device, said storage device comprising:

a base element including:

a first portion of flexible sheet material; and a resilient frame attached to said first portion of flexible sheet material to bias said first portion of flexible sheet material into an erected condition wherein said first portion of sheet material forms a peripheral side wall defining an interior space, a base at one end of said side wall that closes off said interior space at said one end of said side wall, and an opening at an opposite end of said side wall to provide access into said interior space, said first portion of flexible sheet material being movable into a collapsed condition against biasing from said resilient frame to collapse said side wall; and a closure element attached to said base element, said closure element being movable from a covering position wherein said closure element covers said opening to an open position wherein said closure element permits access to said interior space through said opening, said closure element including:

a second portion of flexible sheet material; and a plurality of vanes attached to said second portion of flexible sheet material, said closure element having a trailing edge attached to one side of said opening and a leading edge defined by a leading vane that can be moved (a) to an opposite side of said openings so as to move said closure element into said covering position, and (b) away from the opposite side of said opening so as to move said closure element toward said open position, said second portion of flexible sheet material following the pivotal movement of said leading vane between said covering and open positions, wherein said closure element is movable with said first portion of said flexible sheet material when said first portion of flexible sheet material moves between erected and collapsed conditions.

2. A collapsible storage device according to claim 1, wherein said plurality of vanes of said closure element are retained in position by one of a grommet and rubber band.

3. A collapsible storage device according to claim 1, wherein when said closure element is in said covering position, said closure element extends upwardly from said opening.

4. A collapsible storage device according to claim 1, wherein said closure element is provided with a lip portion which protrudes outwardly from said side wall when said closure element is in said covering position.

5. A collapsible storage device according to claim 4, wherein said lip portion is adjacent said leading edge of said closure element.

6. A collapsible storage device according to claim 1, wherein said resilient frame is attached to said first portion of flexible sheet material along an interior surface of said first portion of flexible sheet material.

7. A collapsible storage device according to claim 1, wherein all of an external surface of said side wall is available for printed matter to be applied thereto and displayed in an uninterrupted manner.

8. A collapsible storage device according to claim 1, wherein said closure element is molded from plastics material.

9. A collapsible storage device according to claim 1, wherein a portion of said closure element is formed from a material having at least one aperture.

10. A collapsible storage device according to claim 1, wherein said plurality of vanes are rigid.

11. A collapsible storage device according to claim 1, wherein said resilient frame is attached to said first portion of flexible sheet material in a helical configuration.

12. A collapsible storage device according to claim 1, wherein said side wall is cylindrical.

13. A collapsible storage device according to claim 1, further comprising a retainer structured to maintain said closure element in said covering position.

14. A collapsible storage device according to claim 1, wherein said base element includes handles on opposing sides of said side wall.

15. A collapsible storage device, said storage device comprising:

a base element including:

a first portion of flexible sheet material; and a resilient frame attached to said first portion of flexible sheet material to bias said first portion of flexible sheet material into an erected condition wherein said first portion of sheet material forms a peripheral side wall defining an interior space, a base at one end of said side wall that closes off said interior space at said one end of said side wall, and an opening at an opposite end of said side wall to provide access into said interior space, said first portion of flexible sheet material being movable into a collapsed condition against biasing from said resilient frame to collapse said side wall; and a closure element attached to said base element, said closure element being movable from a covering position wherein said closure element covers said opening to an open position wherein said closure element permits access to said interior space through said opening, said closure element including:

a second portion of flexible sheet material; and a plurality of vanes attached to said second portion of flexible sheet material, said closure element having a trailing edge attached to one side of said opening and a leading edge defined by a leading vane that can be moved (a) to an opposite side of said opening so as to move said closure element into said covering position, and (b) away from the opposite side of said opening so as to move said closure element toward said open position, said second portion of flexible sheet material following the pivotal movement of said leading vane between said covering and open positions, wherein said closure element is movable with said first portion of flexible sheet material when said first portion of flexible sheet material moves between erected and collapsed conditions, wherein said resilient frame is attached to said first portion of flexible sheet material via the formation of a housing in a helical form along a surface of said first portion of flexible sheet material.

16. A collapsible storage device according to claim 15, wherein said surface is an interior surface of said first portion of flexible sheet material.

17. A collapsible storage device, said storage device comprising:

a base element including:

a first portion of flexible sheet material; and a resilient frame attached to said first portion of flexible sheet material to bias said first portion of flexible sheet material into an erected condition wherein said first portion of sheet material forms a peripheral side wall defining an interior space, a base at one end of said side wall that closes off said interior space at said one end of said side wall, and an opening at an opposite end of said side wall to provide access into said interior space, said first portion of flexible sheet material being movable into a collapsed condition against biasing from said resilient frame to collapse said side wall; and a closure element attached to said base element, said closure element being movable from a covering position wherein said closure element covers said opening to an open position wherein said closure element permits access to said interior space through said opening, said closure element including:

a second portion of flexible sheet material; and a plurality of vanes attached to said second portion of flexible sheet material, said closure element having a trailing edge attached to one side of said opening and a leading edge defined by a leading vane that can be moved (a) to an opposite side of said opening so as to move said closure element into said covering position, and (b) away from the opposite side of said opening so as to move said closure element toward said open position, said second portion of flexible sheet material following the pivotal movement of said leading vane between said covering and open positions, wherein said closure element is movable with said fist portion of flexible sheet material when said first portion of flexible sheet material moves between erected and collapsed conditions, wherein at least one ventilation aperture is provided in said device.

18. A collapsible storage device according to claim 17, wherein said at least one aperture is provided in said closure element.

* * * * *